US005748759A

United States Patent [19]

Croft et al.

[11] Patent Number: 5,748,759

[45] Date of Patent: May 5, 1998

[54] LOUD SPEAKER STRUCTURE

[75] Inventors: James Joseph Croft, Everett; Robert C. Williamson, Mountlake Terrace, both of Wash.

[73] Assignee: Carver Corporation, Lynnwood, Wash.

[21] Appl. No.: 417,206

[22] Filed: Apr. 5, 1995

[51] Int. Cl.[6] ..... H04R 25/00

[52] U.S. Cl. ..... 381/193; 381/204; 181/171; 181/172

[58] Field of Search ..... 381/193, 188, 381/205, 159, 158; 181/171, 172

[56] References Cited

U.S. PATENT DOCUMENTS

| | | | |
|---|---|---|---|
| 1,606,571 | 11/1926 | Heising . | |
| 1,730,528 | 2/1929 | Robbins . | |
| 1,829,355 | 7/1931 | Houghton . | |
| 2,141,208 | 3/1938 | Eaves . | |
| 2,234,007 | 3/1941 | Olson et al. | 181/172 |
| 2,439,666 | 4/1948 | Marquis | 181/172 |
| 2,490,466 | 12/1949 | Olson et al. | 181/172 |
| 2,655,566 | 5/1953 | Pittinger . | |
| 2,661,412 | 11/1953 | Dreyfus . | |
| 2,713,396 | 7/1955 | Tavares . | |
| 2,810,021 | 1/1957 | Brownscombe . | |
| 2,846,520 | 11/1958 | Brownscombe . | |
| 3,019,849 | 7/1962 | King . | |
| 3,684,052 | 8/1972 | Sotome . | |
| 3,700,225 | 10/1972 | Fader et al. . | |
| 4,008,374 | 2/1977 | Tiefenbrun . | |
| 4,239,943 | 12/1980 | Czerwinski . | |
| 4,327,257 | 4/1982 | Schwartz | 381/197 |
| 4,378,935 | 4/1983 | Brown et al. . | |
| 4,384,174 | 5/1983 | Suzuki et al. | 381/158 |
| 4,547,631 | 10/1985 | Nieuwendijk et al. . | |
| 4,607,382 | 8/1986 | Dijkstra et al. . | |
| 4,657,229 | 4/1987 | Thurow . | |
| 4,722,516 | 2/1988 | Gregg . | |
| 4,722,517 | 2/1988 | Dijkstra et al. . | |
| 5,123,053 | 6/1992 | House . | |
| 5,147,986 | 9/1992 | Cockrum et al. . | |
| 5,327,504 | 7/1994 | Hobelsberger | 381/159 |
| 5,346,187 | 9/1994 | Drescher . | |

FOREIGN PATENT DOCUMENTS

| | | | |
|---|---|---|---|
| 60-185494 | 9/1985 | Japan | 381/193 |

OTHER PUBLICATIONS

"Improvement of Low–Frequency Response In Small Loudspeaker Systems by Means of the Stabilized Negative–Sspring Principle" The Journal of the Acoustical Society of America Dec. 22, 1970, vol. 49, No. 5 (Part 1) 1971 pp. 1362–1367.

*Primary Examiner*—Sinh Tran
*Attorney, Agent, or Firm*—Seed and Berry LLP

[57] ABSTRACT

Disclosed is a loudspeaker apparatus having at least one support surface provided therein adjacent to a complaint surround for providing lateral support thereto, the surround mounting the diaphragm of the speaker to a speaker frame for permitting longitudinal movement of the diaphragm with respect to the frame. The support surface may be used with a variety of surrounds. A second support surface may also be provided. The support surfaces may be contoured to achieve a desired response from their engagement with the surround. A negative air spring is formed from a pair of opposed support surfaces contoured to form a necked region therebetween for deformingly engaging a surround formed as a resilient member. The negative air spring negatively balances, or counterbalances the diphragm against the box pressures with the enclosure. The resilient member is formed as a tube for containing a fluid such as air therein. The pressure within the resilient member is controlled in response to a variety of parameters.

37 Claims, 5 Drawing Sheets

FIG. 1
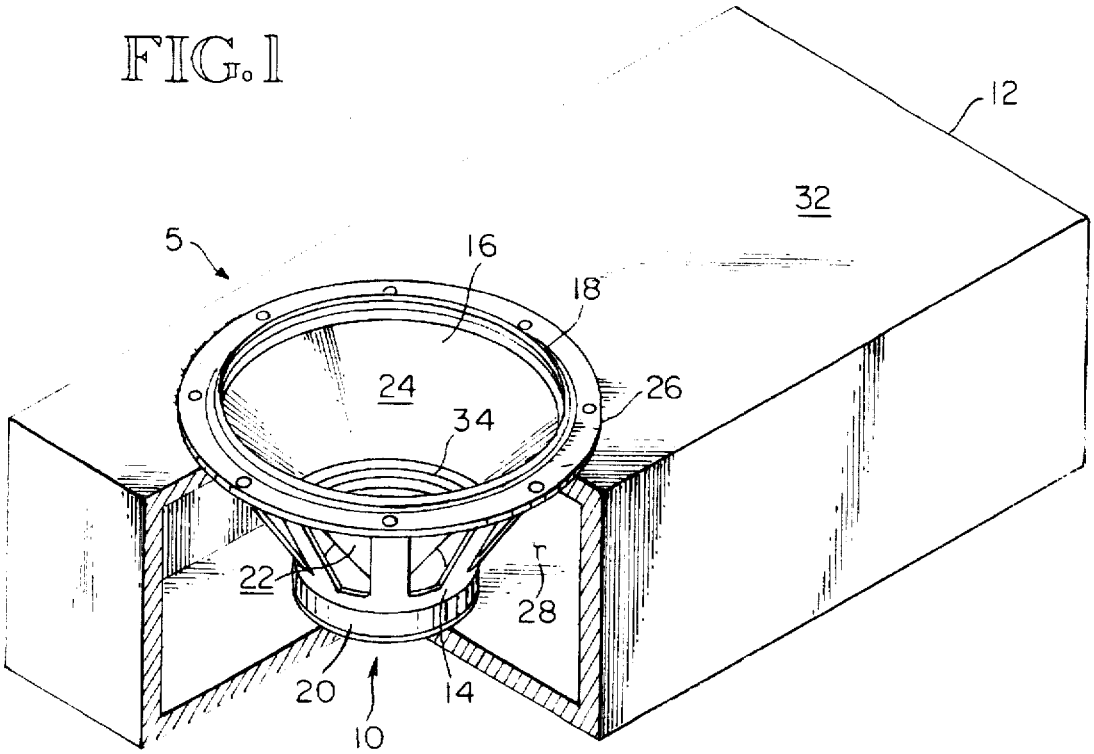
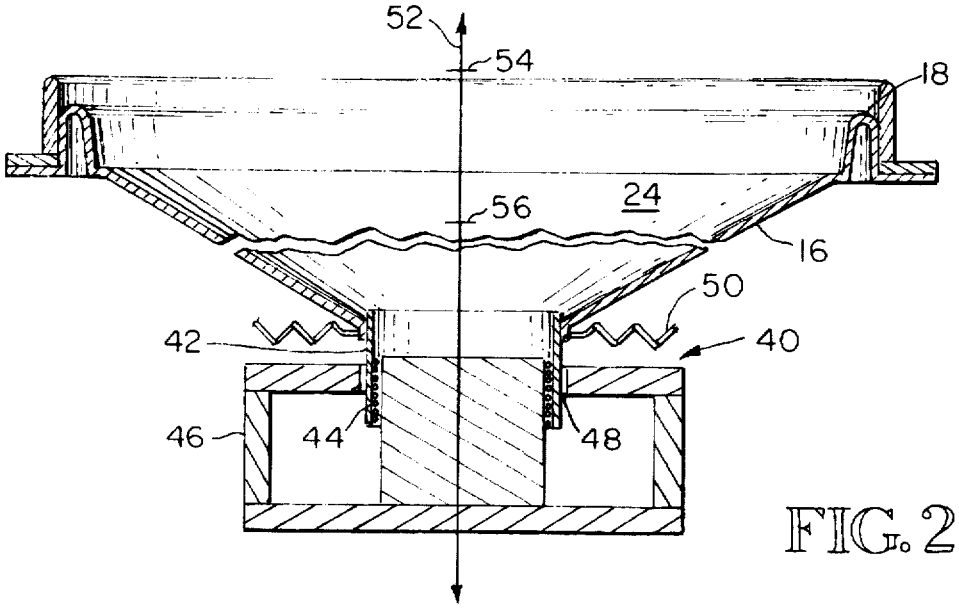
FIG. 2

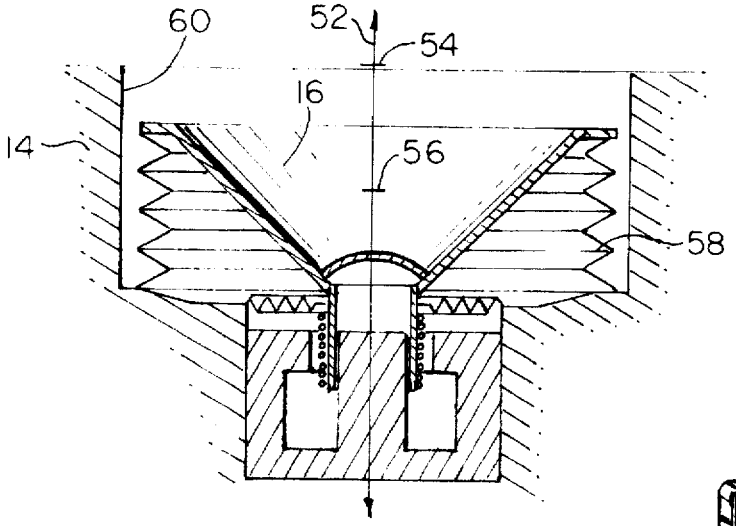
FIG. 3
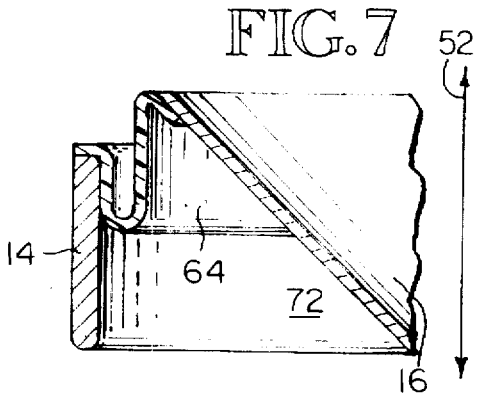
FIG. 7
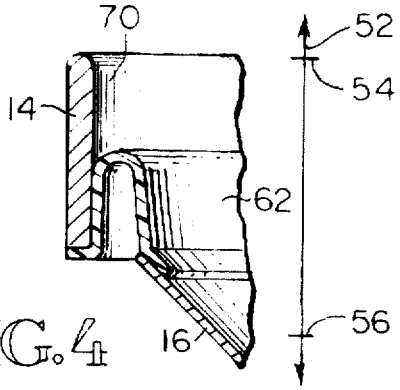
FIG. 4
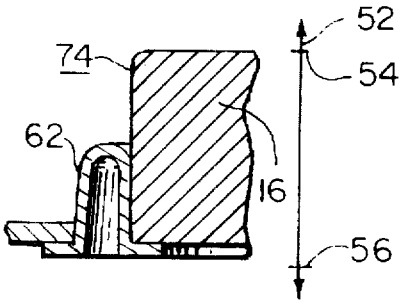
FIG. 8
FIG. 5
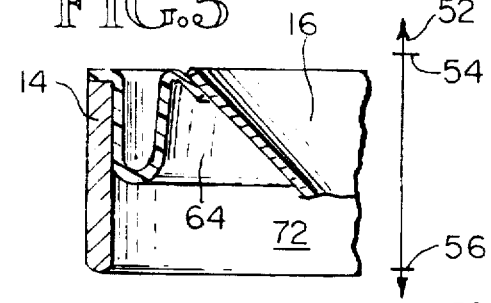
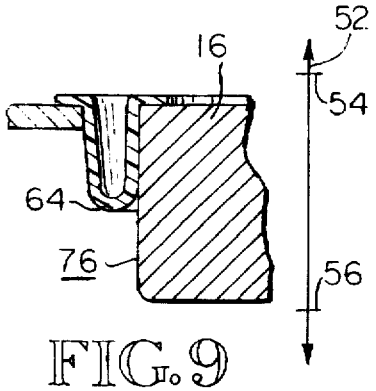
FIG. 9
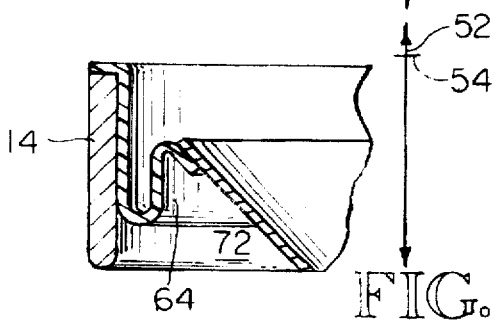
FIG. 6

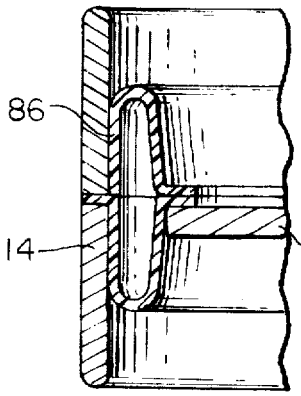
FIG. 10
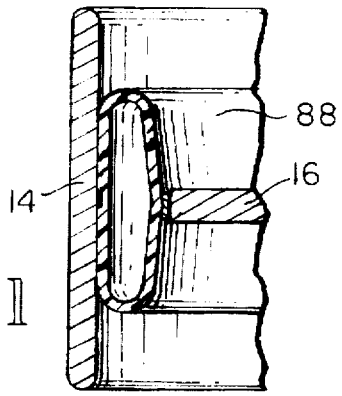
FIG. 11
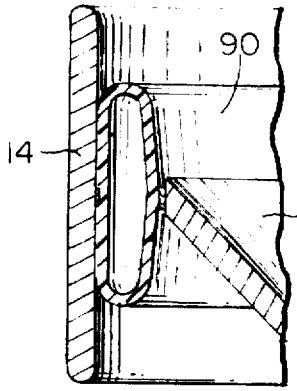
FIG. 12
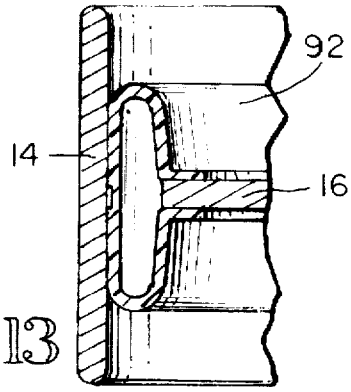
FIG. 13
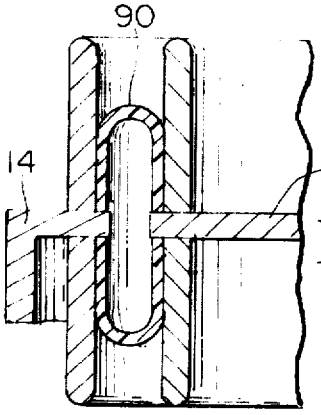
FIG. 14
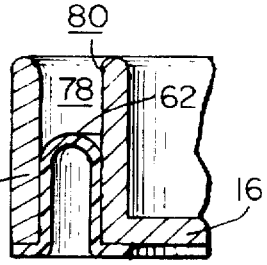
FIG. 15
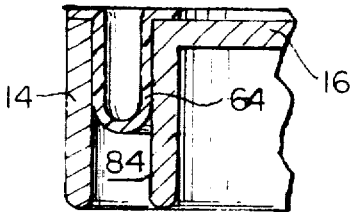
FIG. 16
FIG. 17
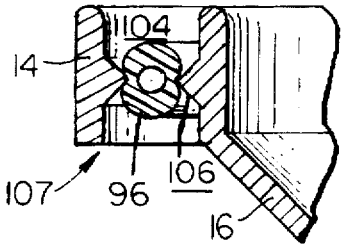

FIG. 19
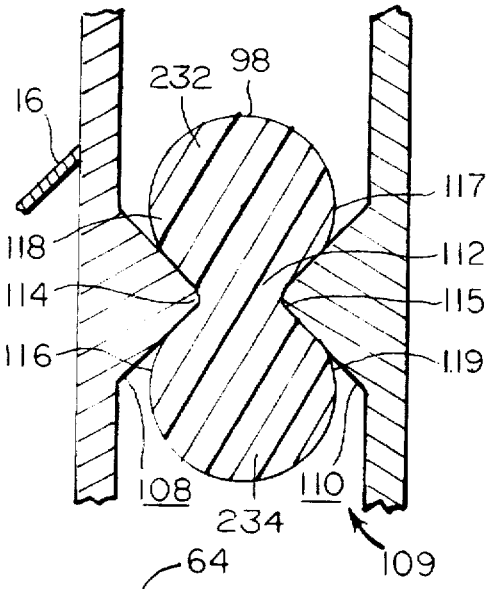
FIG. 20
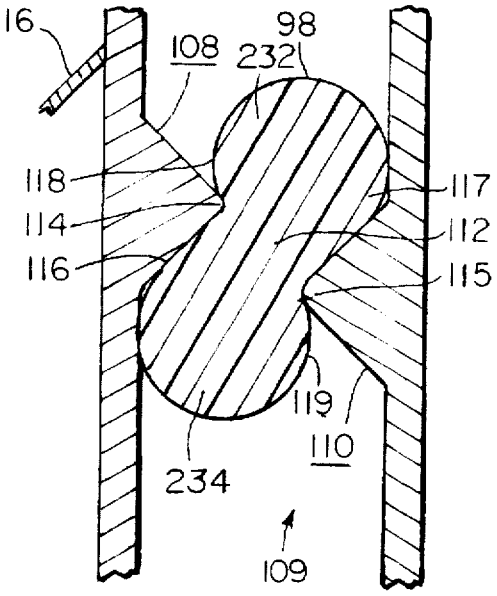
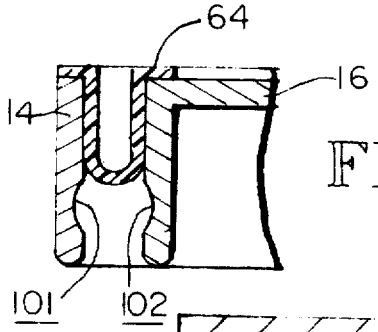
FIG. 18
FIG. 22
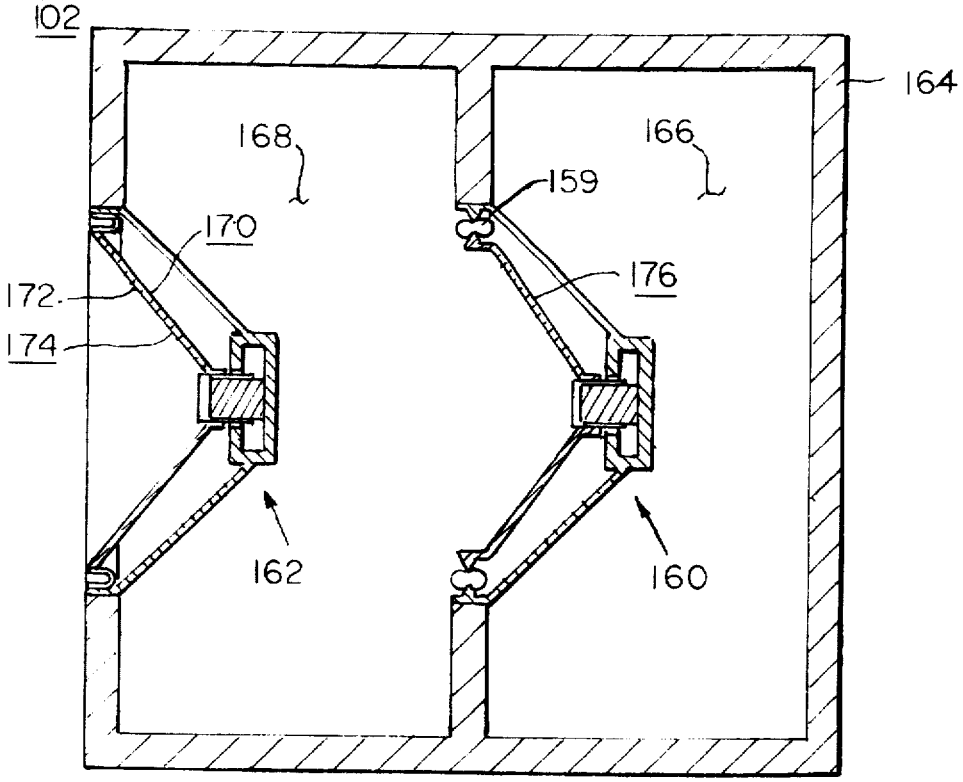

LOUD SPEAKER STRUCTURE

BACKGROUND OF THE INVENTION

1. Field of the Invention

The present invention relates to the field of transducers for converting between electromagnetic signals and sound. In particular, the invention relates to apparatus and methods for providing lateral support to speaker surrounds and for negatively balancing the speaker diaphragms against the box pressures.

2. Description of the Prior Art

Speakers generally comprise an acoustic diaphragm, a frame in which the diaphragm is mounted, a mechanism for mounting the diaphragm in the frame, commonly known as a surround or speaker surround, and a means for driving the diaphragm at desired frequencies in response to an input signal. Additionally, an enclosure is usually provided about the rear face of the acoustic diaphragm, the front face of the diaphragm acoustically coupled to the exterior of the enclosure. The enclosure prevents radiation from the rear face of the diaphragm from canceling radiation from the front face.

In most speaker systems, the acoustic diaphragm is made from a relatively rigid material for moving air at the desired frequency with relatively little physical distortion of the diaphragm. Typical materials for diaphragms include stiff paper, which is often coated, and polypropylene. While almost any shape is suitable, a cone-shaped or fustro-conical shaped diaphragm is the most common shape used in audio speakers.

To permit the rigid diaphragm to move or travel relative to the frame, a compliant surround is interposed between the diaphragm and the frame, connecting the diaphragm and frame together. The diaphragm is supported from the frame by the surround such that it may travel along an excursion axis between a maximum negative excursion limit, displaced inward toward the interior of the enclosed volume and a maximum positive excursion limit, displaced outward toward the exterior of the enclosure.

There are several methods of achieving compliance of the surround. A first method is to form the surround as a bellows or accordion pleat, the axis of expansion of the bellows being along the axis of translation of the diaphragm, while the axis of expansion of the pleat is perpendicular thereto. A second method is to form the surround of an elastomeric material. Older speaker models tended to be based on the bellows structure while more recent designs focus on the use of various elastomeric materials.

In addition to providing for relative movement between the diaphragm and the frame the surround may be used in connection with an enclosure to isolate the volume associated with the rear face of the diaphragm from the volume associated with the front face of the diaphragm. This requires the surround to be in sealing engagement with the diaphragm and the frame along the entirety of both of their peripheries.

As mentioned above, the surround will typically be used with a fustro-conical shaped diaphragm. To provide the maximum support and to achieve isolation the surround has usually been formed as an annulus between the conical diaphragm and the frame. The early bellows and accordion pleat surrounds had cross-sections that were substantially triangular. Most current surrounds have a substantially arcuate cross-section.

To achieve a long excursion in surrounds having an arcuate cross-section the radius of curvature must be increased. However, the larger radius of curvature reduces the surround's ability to withstand greater box pressures, while the increase in the excursion limits simultaneously increases those box pressures. It is therefore difficult to create an arcuate cross-section surround that has long excursion while withstanding high box pressures.

It is also known to employ a surround having a substantially U-shaped cross-section, the portion of the surround between the arms of the U forming the elbow lobe or meniscus. The surround is known as a half roll if it is an open ended structure, and full roll if it is a close structure. The full roll surround may be formed as two half rolls or as an integral full role structure.

Additionally, an annular, tube shaped surround has been suggested in the art. The tube is composed of an outer wall which defines a cavity therein.

Various means for moving the diaphragm are known. The most common means is electrodynamic, in which a voice coil is attached to the diaphragm and suspend within a magnetic field. Movement of the voice coil is obtained by varying the current flowing therethrough, which in turn results in movement of the diaphragm. Another means for moving the diaphragm is termed electrostatic. In electrostatic speakers a static charge is maintained on the diaphragm which is movably mounted between a pair of grids. The movement of the diaphragm is achieved by controlling the distribution of charge on the grids which attract and repel the charged diaphragm.

It is important to minimize the mass of the moving parts of the speaker to achieve efficient operation. It is also important to increase the rigidity and size the diaphragm to achieve a low frequency response having little distortion. Designers have focused on reducing the mass of the cone and voice coil to achieve high efficiency while maintaining fidelity. However, since a decrease in mass of the diaphragm is usually associated with a decrease in its rigidity, a different approach would prove valuable.

One such approach is to concentrate on the reduction in the mass of a speaker surround. However this has typically resulted in a reduction in the strength of the surround. In audio applications, the surround is subjected to repetitive oscillation at a variety of frequencies extending upwards to at least 20 kHz. The surround is also subjected to extreme pressure differentials known as box pressure. The oscillations tend to stress the surround in a longitudinal fashion while the pressure differentials often create lateral stresses. These stresses lead to dimpling and buckling in the surround which gives rise to a speaker performance failure in terms of acoustic distortion. The distortion is associated with the nonlinear stiffness and the torquing action introduced by the dimpling and buckling of the surround. Dimpling and buckling also give rise to an acoustic output phase cancellation between the diaphragm and the surround.

Locating a speaker in an enclosure to acoustically isolate the front and rear diaphragm surfaces has a drawback. The enclosure will cause the resonant frequency of the diaphragm to rise. This effect is particularly acute in low frequency applications such as woofers and subwoofers where the enclosure can raise the resonance frequency from between 20 Hz and 70 Hz, or even more. Since the range of human hearing extends from approximately 20 Hz to 20 kHz, it is desired to maintain the resonance frequency as close to or below the 20 Hz level as possible.

The rise in resonance frequency is due to the effect that the enclosed air volume has on the diaphragm during its positive and negative excursions. The air enclosed in the enclosure acts as a spring, or positive air spring, providing a stiffness to the system. As the diaphragm moves inward, the air in the enclosure is compressed creating an increasing pressure within the enclosure which resists further inward travel of the diaphragm. As the diaphragm moves outward, the air in the enclosure is rarefied, the partial vacuum resisting further positive excursion of the diaphragm.

A method of maintaining the resonance frequency at or near its free air level is to simulate a larger box. There are two known approaches to achieving this effect. The first is providing a negative mechanical spring to negatively balance or counterbalance the stiffness of the air spring (positive) generated by the enclosure. Mechanical springs have not proved suitable due to the noise they generate and the lack of linearity between their positive and negative deflections.

The other known method is to control the environment within the enclosure. The enclosure is divided into at least two chambers, a first speaker acoustically couples the first and second chambers, a second speaker acoustically coupling the second chamber and the exterior of the enclosure. In this way the second speaker can be driven to maintain the air pressure in the first chamber at a constant level to produce an isobaric effect in the second chamber. The second speaker may be coupled to the chamber either directly, the diaphragm defining a portion of the chamber or indirectly through the use of ports.

There is a demonstrated need in the audio field for a device which overcomes the aforementioned problems and provides a low mass, compliant surround, having a long excursion and capable of linear output over that excursion, and which is not subject to performance failure associated with premature deformation and distortion, and which does not have a reduction in acoustic output due to phase cancellation between the diaphragm and the surround. There is also a need for an efficient and low cost system for maintaining the resonance frequency of a diaphragm in an enclosure at a frequency low enough to ensure wide band fidelity. There is a further need for a speaker structure capable of delivering high fidelity, low frequency response from a relatively small enclosure.

SUMMARY OF THE INVENTION

The present invention is directed to a surround, supporting surfaces for the surround and negative air springs for use in loud speaker devices.

At least one support surface is provided adjacent the surround to provide lateral support and a rolling surface therefore. The support surface may be attached to the speaker frame or the diaphragm, or each may be provided with its own respective separate support surface. The shape, dimensions and materials for the surround and the support surfaces may be modified to achieve any desired response therefrom.

As a surround is made long and narrow, its meniscus is strengthened, while its arms become more vulnerable. The inclusion of a support surface along an arm of the surround gives rise to a number of benefits. The support surface provides lateral strength to the arm, permitting a reduction in the radius of curvature of the meniscus without a loss of integrity. The smaller radius of curvature results in a surround that can withstand higher box pressures. The ability to withstand higher box pressures permits a smaller enclosure to be used if desired. Providing lateral support to the surround also permits the length of the surround to be increased, which increases the maximum positive and negative excursion limits of the diaphragm.

Additionally, the support surface permits the thickness of the surround's wall to be reduced without reducing the integrity of the wall. The reduction in wall thickness permits greater compliance to be achieved by the surround. It may also be equated with a reduction in the mass of the surround. Additionally, the reduction in wall thickness results in a reduction in the difference between the inner and outer circumference as measured at the meniscus. The reduction in wall thickness reduces binding. Reduced binding means an even smaller radius of curvature can be used at the meniscus, which again increases the surround's ability to withstand high box pressures.

A negative air spring is provided, which may simply serve the function of negatively balancing the diaphragm against the positive air spring effect of the enclosure, or may additionally serve as the surround. The negative air spring includes a resilient member received between a pair of supporting surfaces, one surface associated with the diaphragm for movement therewith and the other surface associated with the frame. The negative air spring is deformed into an unstable form or shape by the support surfaces when the diaphragm is at its center position, midway between its maximum positive and maximum negative excursion limits. The negative air spring urges the diaphragm into its direction of travel during both negative and positive excursions to counteract the positive air spring produced by the enclosed volume, thus negativley, or counter balancing the diaphragm against the box pressures.

The negative air spring may be implemented as a tube containing air or other fluid which may be maintained at a pressure greater than one atmosphere. A pump means may be associated with the negative air spring to maintain the pressure therein, or to change the pressure in response to a set of pre-defined criteria or in response to user activation.

The use of a negative air spring which has an unstable form when the diaphragm is centered results in a linear response over substantially the entire range of excursion, even at small initial offsets of the diaphragm from the center position. The negative air spring is quieter than its mechanical counterpart. Additionally, the negative air spring provides added stability, and can function as a surround, in addition to its counter-balancing function.

A first object of the invention is to provide a speaker surround and support surface which permits the surround to withstand high box pressures and resist dimpling and buckling.

A second object of the invention is to provide a surround that increases fidelity and compliance.

A third object of the invention is to provide a surround and structure which permits a relatively small enclosure to be used in conjunction with a woofer or subwoofer.

A fourth object is to provide a structure that permits a surround to have a long excursion and a small radius of curvature without subjecting the surround to premature performance failure.

A fifth object of the invention is to provide a surround and support structure which functions as a negative air spring for counteracting the air spring forces generated within a speaker enclosure, the negative air spring providing linear response over substantially the entire length of excursion of the diaphragm by urging the diaphragm into the direction of travel.

A sixth object is to provide a surround having a cavity therein for containing air or another fluid, the pressure of which may be controlled.

BRIEF DESCRIPTION OF THE DRAWINGS

FIG. 1 is a perspective cutaway view of a speaker enclosure.

FIG. 2 is a sectional view of the speaker having a U-shaped surround and an outer support surface.

FIG. 3 is a sectional view of the speaker having an accordion bellows and an outer supporting surface.

FIG. 4 is a sectional partial view of the speaker having an outward extending half roll surround and an outward extending outer support surface.

FIG. 5 is a sectional partial view of a speaker having an inward extending half roll surround and an inward extending outer support surface wherein the diaphragm is in the center position.

FIG. 6 is a sectional partial view of a speaker having an inward extending half roll surround and an inward extending outer support surface wherein the diaphragm is at the maximum negative excursion limit.

FIG. 7 is a sectional partial view of a speaker having an inward extending half roll surround and an inward extending outer support surface wherein the diaphragm is at the maximum positive excursion limit.

FIG. 8 is a sectional partial view of a speaker having an outward extending half roll surround and an outward extending inner support surface formed on the diaphragm.

FIG. 9 is a sectional partial view of a speaker having an inward extending half roll surround and an inward extending inner support surface formed on the diaphragm.

FIG. 10 is a sectional partial view of a speaker having a full roll surround formed by two half rolls and an outer support surface.

FIG. 11 is a sectional partial view of a speaker having an integral full roll surround formed as a tube, an outer support surface, and a planar diaphragm.

FIG. 12 is a sectional partial view of a speaker having an integral full roll surround formed as a tube, an outer support surface and a fustro-conical diaphragm.

FIG. 13 is a sectional partial view of the speaker having an integrally formed full roll surround with a break therein for mounting to the diaphragm, and an outer support surface.

FIG. 14 is a sectional partial view of a first embodiment speaker having a full roll surround formed by two half rolls, an inner support surface and an outer support surface.

FIG. 15 is a sectional partial view of a speaker having an outward extending half roll surround, an outward extending outer support surface and an outward extending inner support surface.

FIG. 16 is a sectional partial view of a speaker having an inward extending half roll surround, an inward extending outer support surface and an inward extending inner support surface.

FIG. 17 is a sectional partial view of a speaker having a surround implemented as a hollow tube, and an inner and outer support surfaces forming a necked region.

FIG. 18 is a sectional partial view of a speaker having an inward extending half roll surround, an inward extending outer support surface forming a concavity and an inward extending inner support surface forming a concavity.

FIG. 19 is a sectional partial view of a speaker having a surround implemented as a solid tube, and an inner and outer support surfaces forming a necked region, the diaphragm in the centered position.

FIG. 20 is a sectional partial view of the speaker of FIG. 19, the diaphragm at the maximum positive excursion limit.

FIG. 22 is a sectional view of a first speaker and a second speaker in an isobaric arrangement, the first speaker including a negative air spring as its surround and the second speaker having an inward extending half roll surround and an inward extending outer support surface.

DESCRIPTION OF THE PREFERRED EMBODIMENTS

Figure 21:
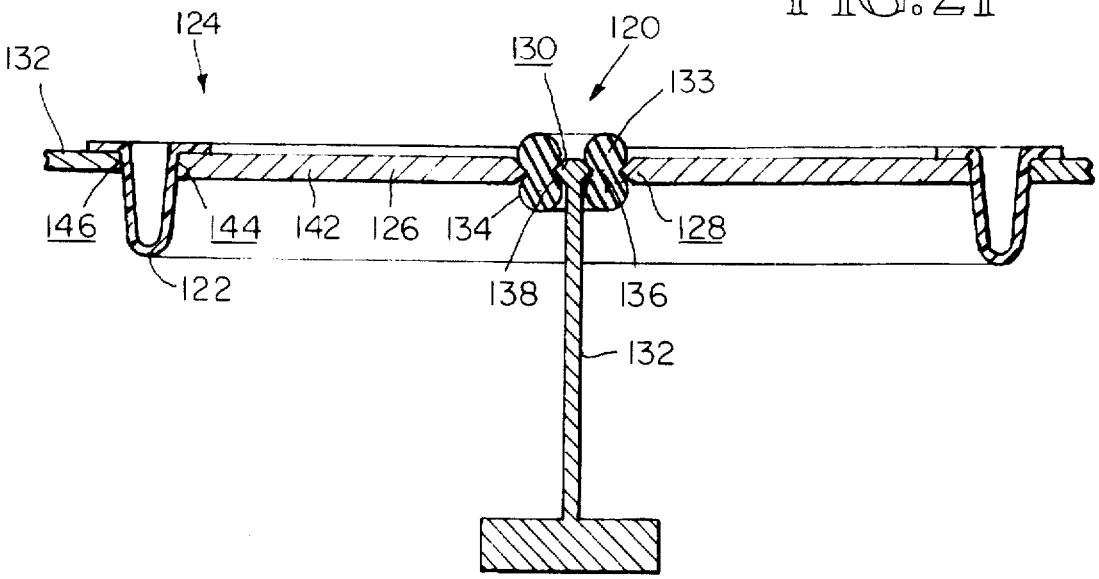
FIG. 21 is a sectional partial view of a speaker having a planar diaphragm, a negative air spring and an inward extending half roll surround.

With reference to FIG. 1, in the preferred embodiment the speaker system 5 includes a speaker 10 mounted in a speaker enclosure 12. The speaker 10 includes a speaker frame 14, a diaphragm 16, a surround 18 for providing compliant support between the speaker frame 14 and the diaphragm 16, and means for moving the diaphragm 20 with respect to the speaker frame 14.

The diaphragm 16 has a lower surface 22 and an upper surface 24. The diaphragm 16 is formed of a rigid material to prevent physical deformation of the diaphragm 16. Materials such as paper, coated paper and polypropylene are suitable. The speaker 10 is mounted in an opening 26 in the enclosure 12, the lower surface 22 of the diaphragm 16 coupled with the interior of the enclosure 28, the upper surface 24 of the diaphragm 16 coupled with the exterior of the enclosure. The speaker frame 14 may be mounted to the front wall 32 of the enclosure 12 using any conventional securing means. A sealing engagement between the speaker frame 14 and the enclosure 12 is preferred to acoustically isolate the volume inside the enclosure 28 from the exterior of the enclosure.

The diaphragm 16 may be any suitable shape, having at least one surface for compressing air, for example, an ellipse, a rectangle or a square. The preferred embodiment will be described in terms of a fustro-conical diaphragm 16. A dust cap 34 may be provided in the fustro-conical diaphragm 16 embodiment.

With reference to FIG. 2, the means for moving the diaphragm 16 preferably include a cylindrically shaped voice coil former 42 fixed to the diaphragm 16, a voice coil 44 disposed about the voice coil former 42 and an annular magnet 46 fixed to the speaker frame 14. The voice coil 44 is formed by wrapping the voice coil former 42 with windings of wire, copper and aluminum being preferred materials. The annular magnet 46 defines a magnetic gap 48 in which the voice coil 44 is received. It is desired to maintain a tight tolerance between the gap 48 and the voice coil 44 to improve efficiency.

While the surround 18 provides some lateral stability, it is preferred to include at least one spider 50 to keep the voice coil 44 centered in the magnetic gap 48, and to prevent pitching, rocking or lateral motion of the voice coil 44, which would otherwise result in the voice coil 44 being scrapped or abraded against the side of the magnet 46 or the pole piece 40.

The surround 18 may be formed in a variety of shapes and may be composed of a variety of materials, so long as the surround 18 is compliant, permitting the diaphragm 16 to move relative to the speaker frame 14. The surround 18 is mounted to the diaphragm 16 and to the speaker frame 14 using conventional adhesives. The surround 18 permits movement of the diaphragm 16 preferably along a single excursion axis 52 between a maximum positive excursion limit 54 and a maximum negative excursion limit 56. When the diaphragm 16 is implemented as a fustro-conical, the axis of excursion 52 is coincident with the axis of the fustro-conical.

An outward extending half-roll surround 62 is shown in FIGS. 4, 8 and 15. An inward extending half-roll surround 64 is shown in FIGS. 5–7, 9 and 16. The half-roll surround 62, 64 has a substantially U-shaped cross-section. The half-roll surround 62, 64 has a pair of arms, joined at an elbow lobe or meniscus at one end and open at the opposite ends thereof. The open end of the U may face the exterior of the enclosure, as shown in FIGS. 5–7, 9 and 16 of the inward extending half roll surround 64 or it may face the interior of the enclosure as shown in FIGS. 2, 4, 8 and 15 of the outward extending half roll surround 62.

With reference to FIG. 4, an outward extending support surface 70 is formed adjacent an outside portion of the half-roll surround 62 to provide lateral supporting engagement thereto, along as least a portion of the excursion of the diaphragm 16 and surround 62. The support surface 70 is substantially parallel to the excursion axis 52 and may be formed from a portion of the speaker frame 14 or attached thereto.

With reference to FIGS. 5–7 an inward extending support surface 72 is formed adjacent an outside portion of the half-roll surround 64 to provide lateral supporting engagement thereto, along as least a portion of the excursion of the diaphragm 16 and surround 64. The support surface is substantially parallel to the excursion axis 52 and may be formed from a portion of the speaker frame 14 or attached thereto.

With reference to FIG. 8 an outward extending support surface 74 is formed adjacent an inside portion of the half-roll surround 62 to provide lateral supporting engagement thereto, along as least a portion of the excursion of the diaphragm 16 and surround 62. The support surface is substantially parallel to the excursion axis 52 and may be formed from a portion of the diaphragm 16 or attached thereto.

With reference to FIG. 9 an inward extending support surface 76 is formed adjacent an inside portion of the half-roll surround 64 to provide lateral supporting engagement thereto, along as least a portion of the excursion of the diaphragm 16 and surround 64. The support surface is substantially parallel to the excursion axis 52 and may be formed from a portion of the diaphragm 16 or attached thereto.

With reference to FIG. 15, an outward extending outer support surface 78 is formed adjacent an outside portion of the half-roll surround 62 and an outward extending inner support surface 80 is formed adjacent the outside portion of the half-roll surround 62 to provide lateral supporting engagement thereto, along as least a portion of the excursion of the diaphragm 16 and surround 62. The support surfaces 78, 80 are substantially parallel to the excursion axis 52 and may be formed from, or attached to, respectively the speaker frame 14 and the diaphragm 16.

With reference to FIG. 16, an inward extending outer support surface 82 is formed adjacent an outside portion of the half-roll surround 64 and an inward extending inner support 84 is formed adjacent an outside portion of the half-roll surround 64 to provide lateral supporting engagement thereto, along as least a portion of the excursion of the diaphragm 16 and surround 64. The support surfaces 82, 84 are substantially parallel to the excursion axis 52 and may be formed from, or attached to, respectively the speaker frame 14 and the diaphragm 16.

With reference to FIGS. 3–9, 15 and 16 the support surface 60, 70, 72, 74, 76, 78, 80, 82, and 84 is preferably made from a material which will not cause undue abrasion to the surround 58, 62, 64. Alternatively, a sleeve of low friction material (not shown) may be provided over the support surface 60, 70, 72, 74, 76, 78, 80, 82, and 84. The support surface 74, 76, 80, 84 attached to the diaphragm 16 should additionally be formed of a high strength to weight ratio material, such as a honeycomb structure, since the mass of the moving components must be minimized to achieve high efficiency.

With reference to FIGS. 5, 7 and 8, the diaphragm 16 is moved according to well known electromechanical means, a current being passed through the voice coil 44, shown in FIG. 2, which is suspended in a magnetic field. As the diaphragm 16 moves toward the maximum positive excursion 54, the meniscus advances, or rolls, outward along the support surface 72, the support surface 72 providing lateral support to that portion of the surround 64 adjacent thereto. As the diaphragm 16 moves toward the maximum negative excursion 56, the meniscus advances, or rolls, inward along the support surface 72, the support surface 72 providing lateral support to that portion of the surround 64 adjacent thereto. Lateral support is of particular concern when the portion of the surround 64 adjacent the support surface 72 becomes relatively long as best seen in FIG. 6. Likewise, a support surface 74, 76, 80, 84 adjacent an inner portion of a surround 62, 64 will provide lateral support to that portion of the surround 62, 64 over substantially the entire length of excursion of the surround 62, 64 and diaphragm 16.

A variety of full-roll surrounds 86, 88, 90, 92, 94 are shown in FIGS. 10–14 respectively. The full roll surrounds 86, 88, 90, 92, 94 have a pair of opposed elbows or meniscus having opposite radii of curvatures.

With reference to FIGS. 10 and 14, the full-roll surround 86, 94 is formed from two half roll surrounds, mounted with their respective open ends in opposition to one another. The ends of each portion of the surround 86, 94 are located adjacent each other as in FIG. 10 or on either side of the frame 14 or diaphragm 16 as in FIG. 14.

Alternatively, the full roll surround 88, 90, 92 is formed as a single integral piece, such as shown in FIGS. 11–13, respectively. The integral full roll surround 88, 90 may be formed as a tube, as shown in FIGS. 11 and 12. Alternatively, the integral full roll surround 92 may have an open edge which is fixed to either the diaphragm 16, as shown in FIG. 13 or fixed to the speaker frame 14, not shown.

With reference to FIGS. 10-14, the full roll surround 86, 88, 90, 92, 94 may have any suitable cross-section. For example, the cross-section may be that of a pair of opposed U-shapes, it may be circular, oval or figure-8 shaped. With reference to FIG. 17, the surround 96 may be formed as a hollow tube, having a concentric cavity formed therein for containing air or another fluid at atmospheric pressure or at a higher pressure. A pressure greater than one atmosphere increases the surround's 96 resistance to dimpling and buckling. Alternatively, with reference to FIGS. 19 and 20, the surround 98 may be formed as a solid annulus, from an elastomer such as rubber or synthetic rubber, or the surround 98 may be semi-solid formed of a foam rubber or similar material.

With general reference to all of the Figures, the provision of a lateral supporting structure permits the wall thickness of the surround to be reduced without reducing the integrity of the surround. The reduction in wall thickness results in a reduction in the difference between the inner and outer circumference as measured at the meniscus. This in turn results in a reduction in binding. The reduction in binding permits a smaller radius of curvature to be used which results in a surround having an increased ability to withstand box pressures, and also permits an increase in the excursion limits of the diaphragm and an increase in surround compliance. The increased ability to withstand box pressures permits a smaller enclosure 12 to be used if desired.

The support surfaces 60, 70, 72, 74, 76, 78, 80, 82, and 84 may have any shape suitable for providing lateral support to the surround 58, 62, 64. While the examples previously discussed provide for support surfaces 60, 70, 72, 74, 76, 78, 80, 82, and 84 substantially parallel to the excursion axis 52, the support surface may be tapered (not shown), or the support surfaces 100, 102 may be concave, as shown in FIG. 18, or the support surfaces 104, 106 may be convex, as shown in FIG. 17 wherein the support surfaces 104, 106 form a pair of opposed, sharp ridges, or, as shown in FIGS. 19 and 20 wherein the support surfaces 108, 110 form a pair of opposed rounded ridges. In general, the support surfaces may be contoured to produce a desired response from the interaction of the surround with the support surfaces.

Enclosing the lower surface 22 of the diaphragm 16 introduces a stiffness in the system as the air within the enclosure 12 is successively compressed and expanded giving rise to an air spring effect. The stiffness causes the diaphragm's resonance frequency to rise, which ruins the base response of the diaphragm 16. With reference to FIGS. 17, and 19–20, the surround 96, 98 respectively, and support surfaces 104, 106, 108, 110 respectively, may function as a negative air spring 107, 109 respectively, forcing the diaphragm 16 into the direction of travel to oppose the positive air spring force effect of the enclosed volume.

With reference to FIGS. 19 and 20, a negative air spring 109 is composed of an outer support surface 108 and an inner support surface 110 which are contoured to define a neck or necked region 112 therebetween. Preferably, the contours are formed as ridges on both the outer and the inner support surface 108, 110 respectively. The apex of each rigid are directly opposed to one another when the diaphragm 16 is at a center position, half way between the maximum positive and the maximum negative excursion limits 54, 56 respectively. The surround is received within the neck region 112, fixed at an inner and an outer attachment area, 114, 115 respectively, to each of the support surfaces 108, 110 by conventional means, such as adhesive. The surround 98 has a first work area 116 adjacent the attachment area 114 and a second work area 117 adjacent attachment area 115 which deformingly engage the respective support surfaces 108, 110 during positive excursions. The surround 98 has a third work area 118 adjacent the attachment area 114 and a fourth work area 119 adjacent attachment area 115 which deformingly engage the respective support surfaces 108, 110 during negative excursions.

The surround 96 used as a negative air spring 107 is implemented as a resilient tube, as shown in FIG. 17 containing air or some other fluid at or above atmospheric pressure. Alternatively, the surround 98 may be composed of a solid or semi-solid elastomer, as shown in FIGS. 19 and 20.

While a variety of undeformed cross-sections are suitable for the surround 96, 98, an undeformed circular or oval cross-section is preferred. With reference to FIGS. 19 and 20, the circular cross-section surround 98 is deformably received between the opposed support surfaces 108, 110 such that the support surfaces 108, 110 deform the surround 98 into a substantially figure-8 cross-section when the diaphragm 16 is in the center position, thereby defining an upper lobe 232 and a lower lobe 234. With particular reference to FIG. 19, while the diaphragm 16 is in the center position, the normally undeformed circular cross-section of the surround 98 is maintained in an inherently unstable figure-8 shaped cross-section. With particular reference to FIG. 20, as the diaphragm 16 moves relative to the speaker frame 14 between the positive and negative excursion limits 54, 56, the inner support surface 110 moves relative to the outer support surface 108, permitting the surround 98 to approach its more stable, undeformed circular cross-section shape. Preferably, the surround 98 should not be permitted to obtain a circular cross-section since it would be very difficult to return the surround 98 to the more deformed figure-8 cross-section. The forces exerted by the surround 98 on the support surfaces 108, 110 will urge the diaphragm 16 further into the direction of excursion or travel, offsetting the air spring effect of the enclosure 12. Additionally, the negative air spring, 107, 109 will provide a lateral stabilizing effect of the diaphragm 16, and could serve as a substitute for a spider, or as an additional spider.

With reference to FIG. 21, the negative air spring structure 120 is used in conjunction with a surround 122 in a speaker 124 having a substantially annular planar diaphragm 126. The inside periphery of the diaphragm 126 defines a first outer support surface 128 having a ridge shaped cross-section. A first inner support surface 130, also having a ridge shaped cross-section, is defined by a portion of the frame 132. The first inner support surface 130 and the first outer support surface 128 define a necked region 133 therebetween, in which the resilient member 134 is deformingly received. The resilient member 134 is secured at the apex 136, 138 respectively, of each of the first support surfaces 128, 130. An annular, inward extending, surround 122 having a U-shaped cross-section is secured between the outer periphery 142 of the diaphragm 126 which defines a second inner support surface 144 and a second outer support surface 146 which is defined by the frame 132.

With reference to FIG. 22, a further embodiment is shown wherein the negative air spring 159 is used in conjunction with a pair of speakers 160, 162 received in a speaker enclosure 164 in an isobaric arrangement. The speaker enclosure 164 is divided into a first and second chambers 166, 168, respectively. The first speaker 160 is received within the enclosure 164 such that it couples the first and second chambers 166, 168. A second speaker 162 is received in an aperture in the second chamber 168, the lower surface 170 of the diaphragm 172 of the second speaker 162 acoustically coupled with the interior of the second chamber 168 and the upper surface 174 of the diaphragm 172 acoustically coupled with the exterior of the enclosure 164. The first speaker 160 is driven substantially acoustically in phase with the second speaker 162 to maintain an isobaric system within the second chamber 168. Positive excursions of the diaphragm 172 of the second speaker 162 which tend to rarefy the atmosphere in the second chamber 168 are countered with positive excursions of the diaphragm 176 of the first speaker 160 which tends to compress the atmosphere in the second chamber 168. Likewise, negative excursions of the diaphragm 172 of the second speaker 160 which tend to compress the atmosphere within the second chamber 168 are offset by negative excursions of the diaphragm 176 of the first speaker 162.

With general reference to the FIGS. 17, 19–23 the negative air spring 107, 109, 120, 159 is in its most unstable form when the diaphragm 16 is in the center position. While the negative air spring 107, 109, 120, 159 urges the diaphragm 16 out of the center position, the air spring in the enclosure counteracts the counterbalancing force of the negative air spring 107, 109, 120, 159, tending to keep the diaphragm 16 in the center position. However, speaker enclosures 12, 164 are not completely air tight, therefore the enclosure 12, 164 may be expected to eventually lose air pressure over some period of time under the influence of the negative air spring 107, 109, 120, 159. This will cause the diaphragm 16 to travel toward one of the maximum excursion points 54, 56. The farther off center the diaphragm 16 travels the more stable becomes the shape of the negative air spring 107, 109, 120, 159, and the more difficult it will be to move the diaphragm 16 in response to an audio input signal. This drift can result in a nonlinear response, especially in the area of initial offset of the diaphragm 16 from the center position.

Figure 23:
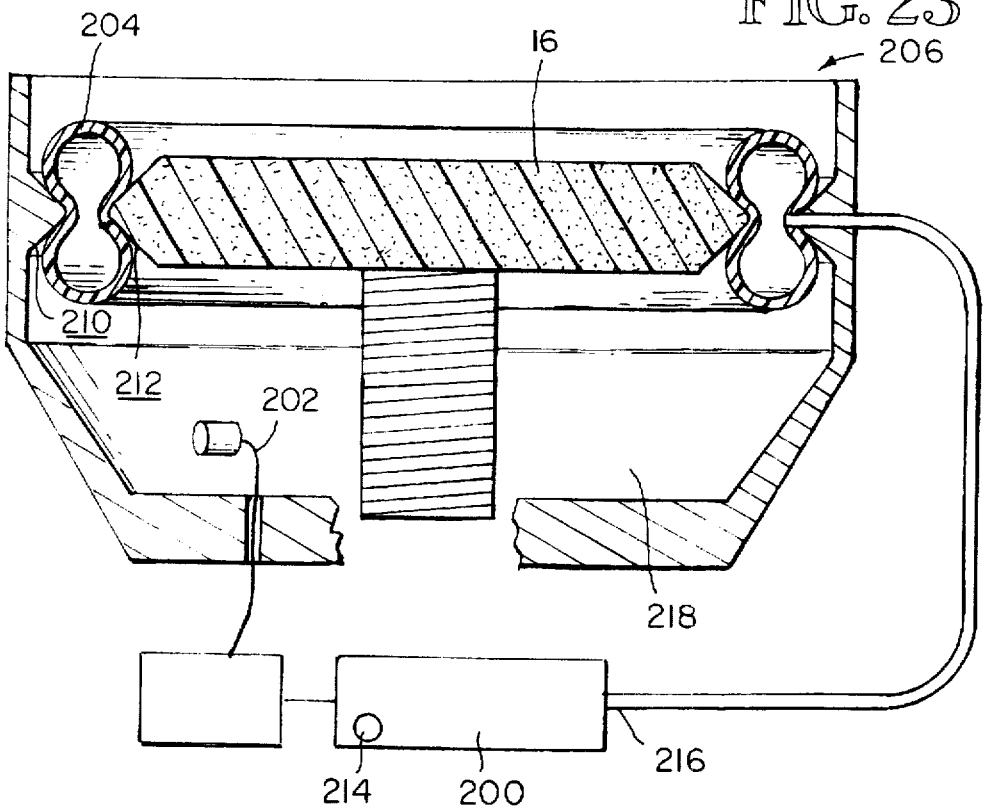
FIG. 23 is a sectional view of a speaker having a negative air spring implemented as a hollow tube surround, detection means and a pump for controlling the pressure within the surround.

With reference to FIG. 23, a pump 200 and detection means 202 are employed to overcome the drift problem by detecting the drift and controlling the pressure within the resilient member 204 of the negative air spring 206. The pressure within the resilient member 204 of the negative air spring 206 is reduced to substantially one atmosphere in response to the audio source being turned off. This relieves the off center forcing or pushing action that the negative air spring 206 exerts on the diaphragm 16 through the support surfaces 210, 212. The resilient member 204 is pressurized when the audio source in turned on to reestablish the counterbalancing force on the diaphragm 16.

A conventional electrical air pump 200 is employed having a first port 214 coupled to the exterior of the enclosure 12 and a second port 216 coupled to the interior of the resilient member 204 whereby the air pressure within the resilient member 204 may be controlled. The detection means 202 is implemented as a conventional position sensor located proximate the speaker 218 to detect movement of the diaphragm 16. Alternatively, the detection means may consist of a conventional pressure sensor to detect the pressure within the enclosure 12. If diaphragm 16 moves outside a predfined limit, the pump 200 reduces the pressure to substantially one atmosphere, permitting the diaphragm 16 to recenter. In another embodiment, not shown, a pump and detection means are employed to overcome the drift problem by detecting the drift and controlling the pressure within the enclosure in response to the drift. As the diaphragm travels off center a signal from the detecting means is used to operate the pump to maintain the pressure within the enclosure. As described above for the isobaric arrangement, the stiffness of the air spring will prevent drift of the diaphragm. The detection means is implemented as either a position sensor, or a pressure sensor. The pump is implemented as a conventional electrical pump having a first port coupled to the exterior of the enclosure and a second port coupled to the interior or the enclosure, whereby air may be pumped into and out of the enclosure. In yet a further embodiment, also not shown, a servo amplifier feedback is associated with the detection means. Again the detection means is implemented as either a position sensor, or a pressure sensor. As the diaphragm travels off center, the amplifier provides a low frequency or DC voltage to the voice coil to recenter the diaphragm. Again, the detection means is implemented as either a position sensor, or a pressure sensor. A feedback loop is provided through the audio amplifier to control the position of he diaphragm using conventional methods.

While the system may be automated to respond to a variety of parameters, it may also be preset or operated by the user.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principals of the invention, and the disclosure is not intended to limit the invention to the particular embodiments described. Those with ordinary skill in the art 10 will appreciate that other embodiments and variations of the invention are possible which employ the same inventive concepts as described above. Therefore, the invention is not to be limited except by the claims which follow.

We claim:

1. An apparatus for providing lateral support to a surround in a loud speaker, the loud speaker having a frame, a diaphragm and a compliant surround connected between the diaphragm and the frame, the surround having a meniscus formed therein such that the meniscus propagates along the surround as the diaphragm translates relative to the frame, the apparatus comprising:

a first support surface on the frame, the first support surface adjacent the surround and presenting a substantially continuous surface over which the meniscus of the surround will roll in response to the translation of the diaphragm relative to the frame; and a second support surface attached to the diaphragm for movement therewith, the second support surface adjacent the surround and presenting a substantially continuous surface over which the meniscus of the surround will roll in the response to the translation of the diaphragm relative to the frame.

2. A sound reproducing device comprising:

a frame;

an acoustic diaphragm;

a compliant surround, the surround connected between the diaphragm and the frame for permitting the diaphragm to move longitudinally along an excursion axis with respect to the frame, the surround forming an elbow as the frame moves between a first position at a maximum positive excursion and a second position at a maximum negative excursion, whereby the elbow travels through the surround; and and rolling surface means for laterally supporting the surround, wherein the rolling surface means comprises an inner support surface attached to the diaphragm for movement therewith, the inner support surface adapted for supportingly engaging the surround such that the elbow of the surround rolls therealong as the diaphragm moves between the first position and the second position.

3. The sound reproducing device of claim 2 wherein the rolling surface means further comprises:

an outer support surface defined on the frame adapted for supportingly engaging the surround such that the elbow of the surround rolls therealong as the diaphragm moves between the first position and the second position.

4. The sound reproducing device of claim 3 wherein the outer support surface is substantially parallel to the excursion axis of the diaphragm.

5. The sound reproducing device of claim 3 wherein the outer support surface is convex.

6. The sound reproducing device of claim 3 wherein the outer support surface forms a first ridge.

7. The sound reproducing device of claim 3 wherein the outer support surface and the inner support surfaces are substantially parallel to the excursion axis of the diaphragm.

8. The sound reproducing device of claim 3 wherein the outer support surface and the inner support surface define a neck portion therebetween.

9. The sound reproducing device of claim 8 wherein the surround is a resilient tube.

10. The sound reproducing device of claim 9 wherein the surround contains air.

11. The sound reproducing device of claim 10 further comprising:

means for controlling the pressure in the surround.

12. The sound reproducing device of claim 2 wherein the inner support surface is substantially parallel to the excursion axis of the diaphragm.

13. The sound reproducing device of claim 3 wherein at least one of the outer and the inner support surfaces are convex.

14. The sound reproducing device of claim 3 wherein at least one of the outer and the inner support surfaces define a ridge.

15. The sound reproducing device of claim 2 wherein the inner support surface is convex.

16. The sound reproducing device of claim 2 wherein the inner support surface forms a second ridge.

17. The sound reproducing device of claim 2 further comprising:

means for causing longitudinal excursions of the acoustic diaphragm.

18. A loudspeaker assembly comprising:

a substantially annular frame;

a fustro-conical speaker diaphragm received concentrically within the frame;

a substantially annular surround sealingly connecting the frame and the diaphragm, the surround being compliant to permit longitudinal movement of the diaphragm relative to the frame along an excursion axis between a maximum positive excursion limit and a maximum negative excursion limit;

an outer support surface defined on the frame adjacent the surround over which a first lobe of the surround rolls as the diaphragm moves between the maximum positive excursion limit and the maximum negative excursion limit; and an inner support surface attached to the diaphragm for movement therewith, the inner support surface adjacent the surround and defining a substantially continuous surface over which the first lobe of the surround will roll as the diaphragm moves between the maximum positive excursion limit and the maximum negative excursion limit.

19. The loudspeaker of claim 18 wherein the outer support surface has a concavity defined therein.

20. The loudspeaker of claim 18 wherein at least one of the outer and the inner support surfaces have a concavity defined therein.

21. The loudspeaker of claim 18 wherein the outer support surface and the inner support surface define a necked region therebetween; and the surround has a substantially O-shaped undeformed cross-section, the surround received in the necked region such that the outer support surface and the inner support surface deformingly engage the surround whereby the first lobe and a second lobe are defined in the surround.

22. A negative spring assembly for a loudspeaker, the loudspeaker comprising a frame and a speaker diaphragm, the negative spring assembly comprising:

an outer support surface formed on the frame;

an inner support surface attached to the speaker diaphragm for movement therewith along an axis of excursion of the diaphragm between a maximum positive excursion limit and a maximum negative excursion limit, the inner support surface spaced from and substantially opposed to the outer support surface, the space between the inner support surface and the outer support surface varying along the axis of excursion of the diaphragm; and a compliant surround received between the outer support surface and the inner support surface, the surround defining an upper lobe and a lower lobe, the surround adapted to deformingly roll along the outer support surface and the inner support surface.

23. The negative spring assembly of claim 22 wherein the outer support surface forms a ridge such that a necked region is defined between the outer support surface and the inner support surface an increasing portion of the upper lobe contacts the outer support surface and a decreasing portion of the lower lobe contacts the outer surface as the diaphragm moves toward the maximum positive excursion limit whereby the diaphragm is biased toward the maximum positive excursion limit, and an increasing portion of the lower lobe contacts the outer support surface and a decreasing portion of the upper lobe contacts the outer support surface as the diaphragm moves toward the maximum negative excursion limit whereby the diaphragm is biased toward the maximum negative excursion limit.

24. The negative spring assembly of claim 22 wherein the inner support surface forms a ridge such that a necked region is defined between the outer support surface and the inner support surface, an increasing portion of the upper lobe contacts the inner support surface and a decreasing portion of the lower lobe contacts the inner surface as the diaphragm moves toward the maximum positive excursion limit whereby the diaphragm is biased toward the maximum positive excursion limit, and an increasing portion of the lower lobe contacts the inner support surface and a decreasing portion of the upper lobe contacts the inner support surface as the diaphragm moves toward the maximum negative excursion limit whereby the diaphragm is biased toward the maximum negative excursion limit.

25. The negative spring assembly of claim 22 wherein the outer support surface forms a first ridge; and the inner support surface forms a second ridge such that a necked region is defined between the outer support surface and the inner support surface, an increasing portion of the upper lobe contacts the outer support surface, a decreasing portion of the upper lobe contacts the inner support surface, an increasing portion of the lower lobe contacts the inner support surface and a decreasing portion of the lower lobe contacts the outer surface as the diaphragm moves toward the maximum positive excursion limit whereby the diaphragm is biased toward the maximum positive excursion limit, and an increasing portion of the lower lobe contacts the outer support surface a decreasing portion of the lower lobe contacts the inner surface an increasing portion of the upper lobe contacts the inner support surface and a decreasing portion of the upper lobe contacts the outer support surface as the diaphragm moves toward the maximum negative excursion limit whereby the diaphragm is biased toward the maximum negative excursion limit.

26. The negative spring assembly of claim 25 wherein the surround is mounted about an apex of the first ridge; and the surround is mounted about an apex of the second ridge.

27. The negative spring assembly of claim 26 wherein the outer support surface is substantially annular; and the inner support surface is concentric with the first surface.

28. The negative spring assembly of claim 25 wherein the surround is a toroid.

29. The negative spring assembly of claim 28 wherein the surround is a tube.

30. The negative spring assembly of claim 29 wherein the surround contains a fluid pressurized to at least one atmosphere.

31. The negative spring assembly of claim 28 wherein the surround has a substantially circular undeformed cross-section.

32. The negative spring assembly of claim 28 wherein the surround has a substantially elliptical undeformed cross-section.

33. A negative spring assembly for a loudspeaker comprising:

a frame having an outer support surface, the outer support surface defining a first ridge:

a speaker diaphragm;

an inner support surface attached to the speaker diaphragm for movement therewith, the inner support surface defining a second ridge spaced from and substantially opposed to the outer support surface: and a solid toroid surround received between the outer support surface and the inner support surface, the surround having a first attachment area mounted to the outer support surface, a second attachment area mounted to the inner support surface, the surround being compliant for permitting translational movement of the inner support surface with respect to the outer support surface, such that the outer support surface deformably contacts a first work area of the surround and the inner support surface deformably contacts a second work area of the surround for negatively balancing the speaker diaphragm from its translated position when the inner support surface moves in a first direction and the outer support surface deformably contacts a third work area of the surround and the inner support surface deformably contacts a fourth work area of the surround for negatively balancing the speaker diaphragm from its translated position when the inner support surface moves in a second direction.

34. A loudspeaker assembly comprising:

a annular frame;

a diaphragm received concentrically within the frame;

a substantially annular resilient surround having an interior, the surround sealingly connecting the frame and the diaphragm, the surround being compliant to permit longitudinal movement of the diaphragm relative to the frame between a maximum positive excursion and a maximum negative excursion;

an outer support surface defined on the frame, the outer support surface adjacent the surround for supportingly engaging the surround such that the surround rolls along the outer support surface as the diaphragm moves between the maximum positive excursion and the maximum negative excursion:

an inner support surface, the inner support surface attached to the diaphragm for movement therewith, the inner support surface adjacent the surround for supportingly engaging the surround such that the surround rolls along the inner support surface as the diaphragm moves between the maximum positive excursion and the maximum negative excursion; and means for controlling the pressure in the surround.

35. The loudspeaker of claim 34 wherein the pressure controlling means comprises a position sensor; and a pump responsive to the position sensor.

36. The loudspeaker of claim 34 wherein the pressure controlling means comprises:

a pressure sensor; and a pump responsive to the pressure sensor.

37. A loudspeaker assembly comprising:

an enclosure having a first chamber and a second chamber defined therein;

a first speaker, the first speaker acoustically coupling the first chamber and the second chamber;

a second speaker, the second speaker acoustically coupling the second chamber and the exterior of the enclosure; and means for negatively balancing the first speaker comprises a mechanical spring, wherein the mechanical spring comprises a first support surface, a second support surface spaced from the first support surface, the second support surface and the first support surface defining a necked region therebetween, and a resilient surround received therebetween, the surround having a meniscus formed therein, for deformingly rolling along the first and the second support surfaces.

* * * * *